US005178006A

United States Patent [19]

Wicks, III et al.

[11] Patent Number: 5,178,006

[45] Date of Patent: Jan. 12, 1993

[54] WELL VELOCITY LOGGING

[75] Inventors: Moye Wicks, III; Boyd B. Moore, both of Houston, Tex.

[73] Assignee: Shell Oil Company, Houston, Tex.

[21] Appl. No.: 807,346

[22] Filed: Dec. 16, 1991

[51] Int. Cl.[5] ..... E21B 47/00

[52] U.S. Cl. ..... 73/155; 73/861

[58] Field of Search ..... 73/155, 861, 861.71; 166/250, 252, 269

[56] References Cited

U.S. PATENT DOCUMENTS

| | | | |
|---|---|---|---|
| 2,868,012 | 1/1959 | Lebourg | 73/155 |
| 3,063,292 | 11/1962 | Glenn et al. | 73/155 |
| 3,905,226 | 9/1975 | Nicolas | 73/155 |
| 3,982,433 | 9/1976 | Stout | 73/155 |
| 4,007,366 | 2/1977 | Wiley et al. | 250/260 |
| 4,326,411 | 4/1982 | Gant et al. | 73/155 |
| 4,581,926 | 4/1986 | Moore et al. | 73/155 |
| 4,662,218 | 5/1987 | Hawthorne | 73/155 |
| 4,736,627 | 4/1988 | Wicks, III et al. | 73/155 |
| 4,817,713 | 4/1989 | Nguyen et al. | 166/252 |

*Primary Examiner*—Hezron E. Williams
*Assistant Examiner*—Michael Brock
*Attorney, Agent, or Firm*—Del S. Christensen

[57] ABSTRACT

A device having a large fluid drag tendency is lowered into a well at a rate which gives no net drag against the fluid. The condition of no net drag is indicated by the tension in a line used to lower the tool into the well. When the spool-off rate is such that this tension force is equal to or slightly exceeds the weight of the tool plus the weight of the line in the borehole the tool is moving at a speed equal to the average flow velocity in the well. This velocity may be determined by measurement of the spool-off rate.

13 Claims, 3 Drawing Sheets

WELL VELOCITY LOGGING

FIELD OF THE INVENTION

This invention relates to an improved injection well velocity logging method and apparatus.

BACKGROUND OF THE INVENTION

Secondary recovery methods to produce oil from subterranean formations include injection of steam, carbon dioxide, and natural gases to drive oil toward recovery wells. Such methods can significantly increase the recovery of oil from many formations, but each is relatively expensive. It is common to use the fuel equivalent of about one-third of the produced oil to produce steam for a steam drive recovery operation. Carbon dioxide and natural gas are also expensive to procure and compress. These recovery processes are therefore economical only if they are carried out in an efficient manner. An important aspect of the efficiency of these processes is the profile of the injection of the drive fluid through multiple sets of well casing perforations and into the formation. This injection profile indicates to the operator, for example, whether portions of the formation are being bypassed, or whether perforations are plugged.

The profile of the injection of drive fluids is typically determined from measuring the velocity of the fluids going down the well borehole, or the velocity profile. This velocity profile is typically determined by either a turbine-type meter or by radioactive tracers. Turbine-type meters are typically lowered into the wellbore on a line. An impeller rotates at a speed which is proportional to the vapor flow, driving a small generator which produces an electrical signal which is proportional to the speed of the impeller rotation. Because turbine meters do not directly measure velocity, but measure the rotation speed of an impeller, they are subject to errors due to calibration. They also require generation of the electronic signal, which relates to the fluid velocity, and transmission of that signal up the borehole.

Radioactive tracers measure velocity by calculation of the time required for a slug of a radioactive tracer to reach detectors which are placed at intervals within the wellbore. The high speeds at which fluids travel down an injection well result in this method rendering data which is of limited resolution. The resolution of the data is particularly troublesome if the sets of perforations are relatively close to each other.

It is also desirable to minimize handling of radioactive tracers. These tracers must not only be handled when injected, but their diluted existence in production fluids must also be considered along with disposal of unused radioactive tracer material.

It is therefore an object of the present invention to provide a method and an apparatus capable of measuring the velocity profile in an injection well wherein radioactive tracers are not required and wherein the velocity can be sampled across a significant portion of the cross-section of the wellbore. It is another object to provide such a method and apparatus which does not require electronic devices or conduction of electronic signals within the wellbore.

SUMMARY OF THE INVENTION

These and other objects of the present invention are achieved by a method to log velocities in a portion of a wellbore comprising the steps of:

providing a high drag member which passes through the portion of the wellbore to be logged with little frictional resistance against the wellbore walls and provides a high drag resistance for fluids passing around the high drag member within the wellbore;

suspending the high drag member within the wellbore by a line;

moving the high drag member within the wellbore at a velocity which results in tension on the line at the wellhead which equals or slightly exceeds the weight of the drag member and line in the wellbore; and determining the velocity of the fluids within the portion of the wellbore by measuring the rate at which the line is being taken up or fed out when the tension on the line slightly exceeds the weight of the drag member and line in the wellbore.

These and other objects are also accomplished by a well logging apparatus capable of measuring fluid velocities within a wellbore comprising:

a) a high drag member which passes through the portion of the wellbore to be logged with little frictional resistance against the wellbore walls and provides a high drag resistance for fluids passing around the high drag member within the wellbore;

b) a line capable of suspending the high drag member within the wellbore;

c) a means to maintain a tension on the line at the wellhead which equals or slightly exceeds the weight of the high drag member and line in the borehole;

d) a means for lowering and raising the high drag member within the wellbore at varying rates; and e) a means for measuring the speed at which the line is going into the wellbore or being pulled out of the wellbore.

The apparatus and method of this invention are capable of logging velocities in a wellbore by directly measuring the rate at which the high drag member is spooling out or being taken up while maintaining a tension on the line which is about equal to the weight of the line in the wellbore. The need for electronic instrumentation within the borehole is thus eliminated.

DETAILED DESCRIPTION OF THE INVENTION

Figure 1:
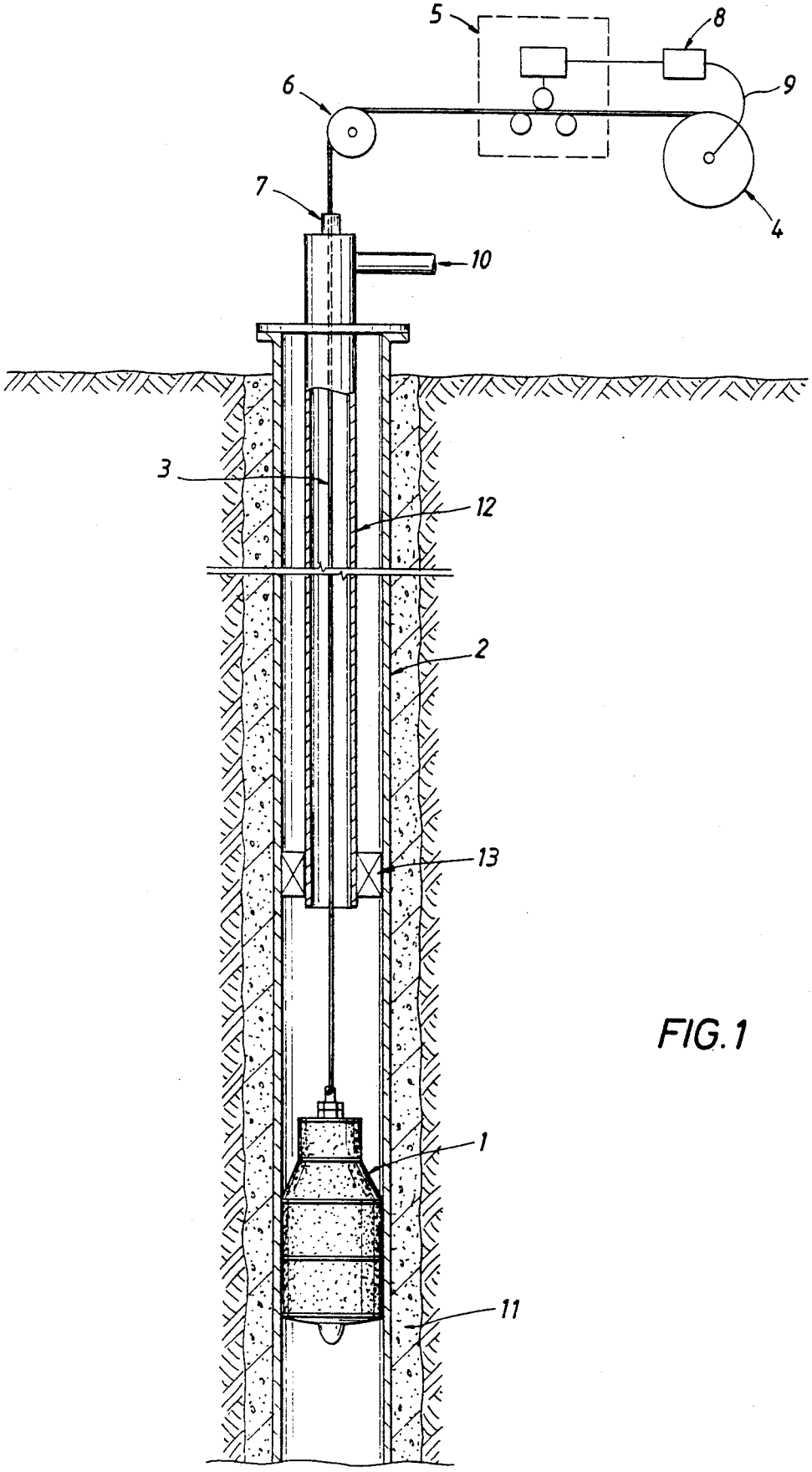
FIG. 1 is a schematic diagram of the apparatus of the present invention.

Referring to FIG. 1, a high drag member, 1, is shown suspended within a casing, 2, in a wellbore, 11, by a line, 3. The line is reeled up and down from a spool, 4. Means to determine the tension on the line at the wellhead is shown as a conventional line weight indicator, 5, on a horizontal section of the line. The line weight indicator, 5, also measures the rate at which the line is going into or out of the borehole and tracks the amount of line in the borehole. The line can then be directed into the wellbore over a sheave, 6, and through conventional wellhead valves and lubricators, 7. The lubricators minimize the flow of well fluids out of the wellhead, while maintaining a minimal drag force on the line. The wellhead also comprises a means for injection of fluids, 10, and a tubing, 12, which extends to a portion of the wellbore which is within an oil bearing formation. The annular space between the tubing and the casing is typically sealed with a packer, 13.

In a preferred embodiment, the rate at which the line is taken up or let out can be directly controlled by way of a feedback controller, 8, providing a control signal, 9, to the spool drive, 4. The feedback controller, 8, preferably considers the amount of line in the borehole and calculates the weight of this line. The feedback controller, 8, preferably also adds the weight of the high drag tool, 1, and the weight of the line within the borehole and controls the speed at which the line is reeled out or taken up to maintain the tension measured by the line weight indicator, 5, at about this total weight. When this total weight, minus an estimate of the frictional drag of the drag member against the borehole walls, is equal to the line weight indication measured, the speed at which the line is being taken in or spooled out is approximately the velocity of the fluids within the wellbore. The weight of the high drag member and the line are preferably minimized, so that these weights can be neglected in estimating the fluid drag around the high drag member, and the tension on the line at the point the line is attached to the high drag member.

Of course, the pressure at the wellhead for example, at the lubricator, 7, and the flow rate at which fluids, 10, are injected, are monitored and preferably held constant. Changes in the rate at which fluids can be injected, or changes in wellhead pressure are indications that the drag member is not, for some reason, traveling in the wellbore at the same speed as the wellbore fluids.

Particularly if the fluids in the wellbore are liquids, the weights of the line and high drag member considered in controlling the speed that the slickline is lowered or raised in the wellbore is preferably the buoyed weight, or the net weight of the components in the wellbore fluids.

Figure 2:
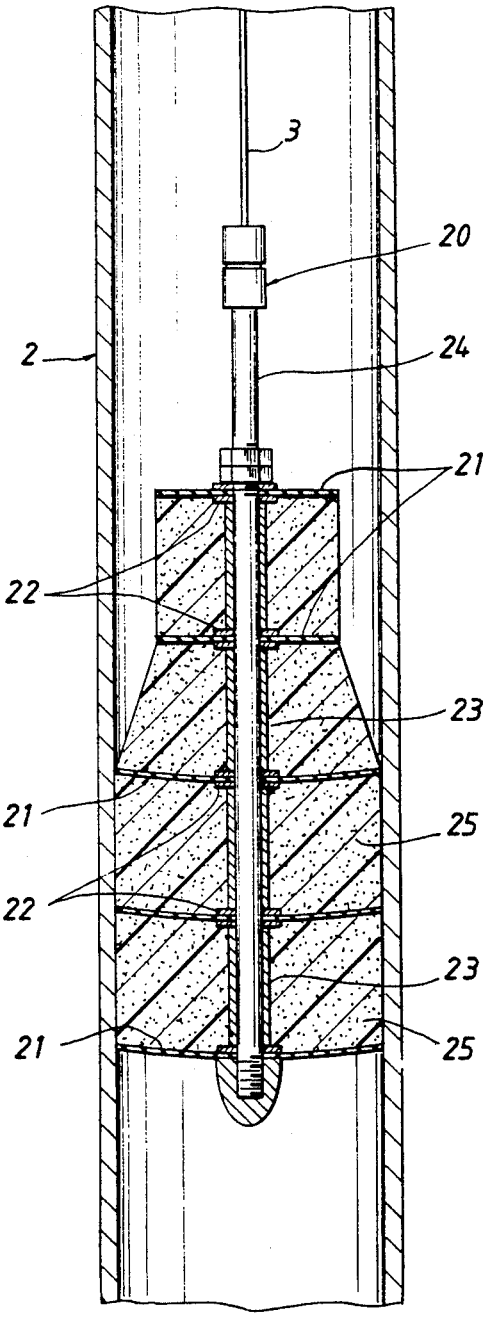
FIG. 2 is a cross-sectional view of a preferred high drag member.

Referring now to FIG. 2, details of a preferred high drag member are shown within a casing, 2, suspended by a line, 3. The line, 3, is preferably attached to the high drag member by a swivel, 20, attached to a bar, 24, around which the high drag member is assembled. The drag of the high drag member can be provided by a plurality of flexible seals, 21 (fine shown). The seals are preferably of a diameter which is about equal to the interval diameter of the casing, 2, in the segment of the wellbore in which fluid velocity is to be logged. These seals can be made of a flexible plastic material such as neoprene, and can be separated by a foam, 25. The foam functions to keep the seals in place. The seals, 21, may be attached to the bar, 24, by washers, 22. The washers may be separated by sleeves, 23.

Figure 3:
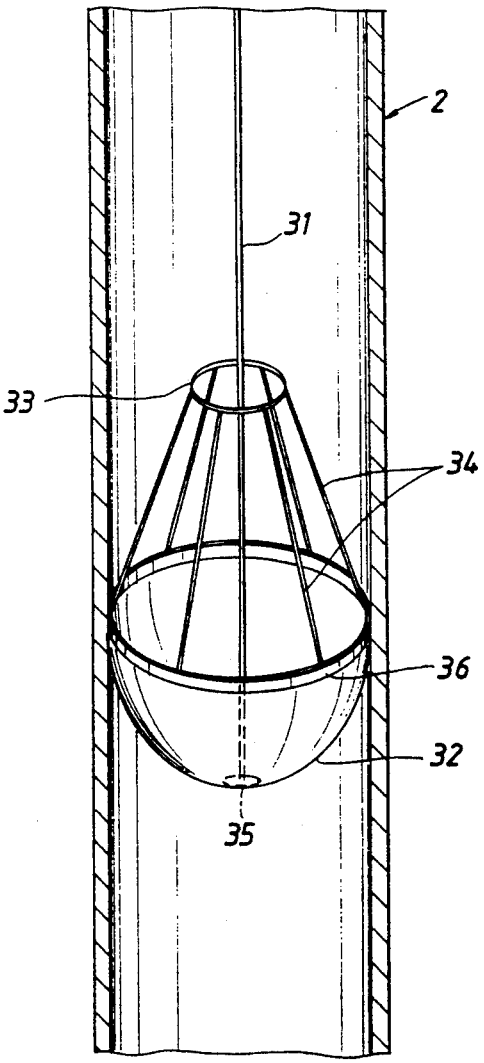
FIG. 3 is a drawing of an alternative preferred high drag member.

Another embodiment of the high drag member is shown in FIG. 3, with the high drag member in an expanded configuration. The collapsed configuration is used to draw the high drag member back out of the wellbore after a logging run. Referring to FIGS. 1 and 3, the high drag member is shown in a casing 2, below the tubing, 12, and packing, 13. The high drag member is suspended from a line, 31. The drag is created by an inverted parachute, 32, which is made of a flexible material such as a fabric or a flexible polymeric film. The parachute is hung from the line by a plurality of hangers, 34, connected to a slip ring, 33. The hangers may be stiff wires, or they may be flexible wires or cords. If the hangers are stiff, they are pivotably connected to the ring, 33. In the expanded configuration, the ring, 33, is optionally secured to the line at a location which results in the hangers, 34, being shorter than the length of the line from the point the ring is attached to the point the line is attached to the parachute at an attachment point, 35, which is centrally located on the parachute. When the ring is attached to the line at such a point, the parachute will tend to stay expanded. When the ring is secured to the line when the parachute is in the expanded configuration, it can be released from the line prior to lifting this high drag member out of the wellbore. With the ring, 33, released from the line 31, the outer rim of the parachute will fall below the center point of the parachute, and instead of forming a parachute, which will tend to expand outward to the walls of the casing, the parachute will form a cone. The hangers, 34, are preferably longer than the radius of the parachute, so that when the ring is released, the parachute will hang from the line attachment point, 35. In this configuration, it can be drawn up through the casing and tubing with a minimal resistance from fluids flowing down the tubing and casing.

Preferably, the slip ring, 33, is not affixed to the line, but is free to slide up and down. When the tension on the line at the attachment point, 35, is low, the parachute, 32, will be held in the open position by the flow of fluids down the wellbore.

The rim of the parachute, 32, may contain a springy band, 36, attached to its circumference to help maintain the shape of the parachute. The springy band is preferably a metal band encased within a wear-resistant surface coating. The springy band must be sufficiently flexible to pass through any tubing which may be present in the injection well.

Figure 4:
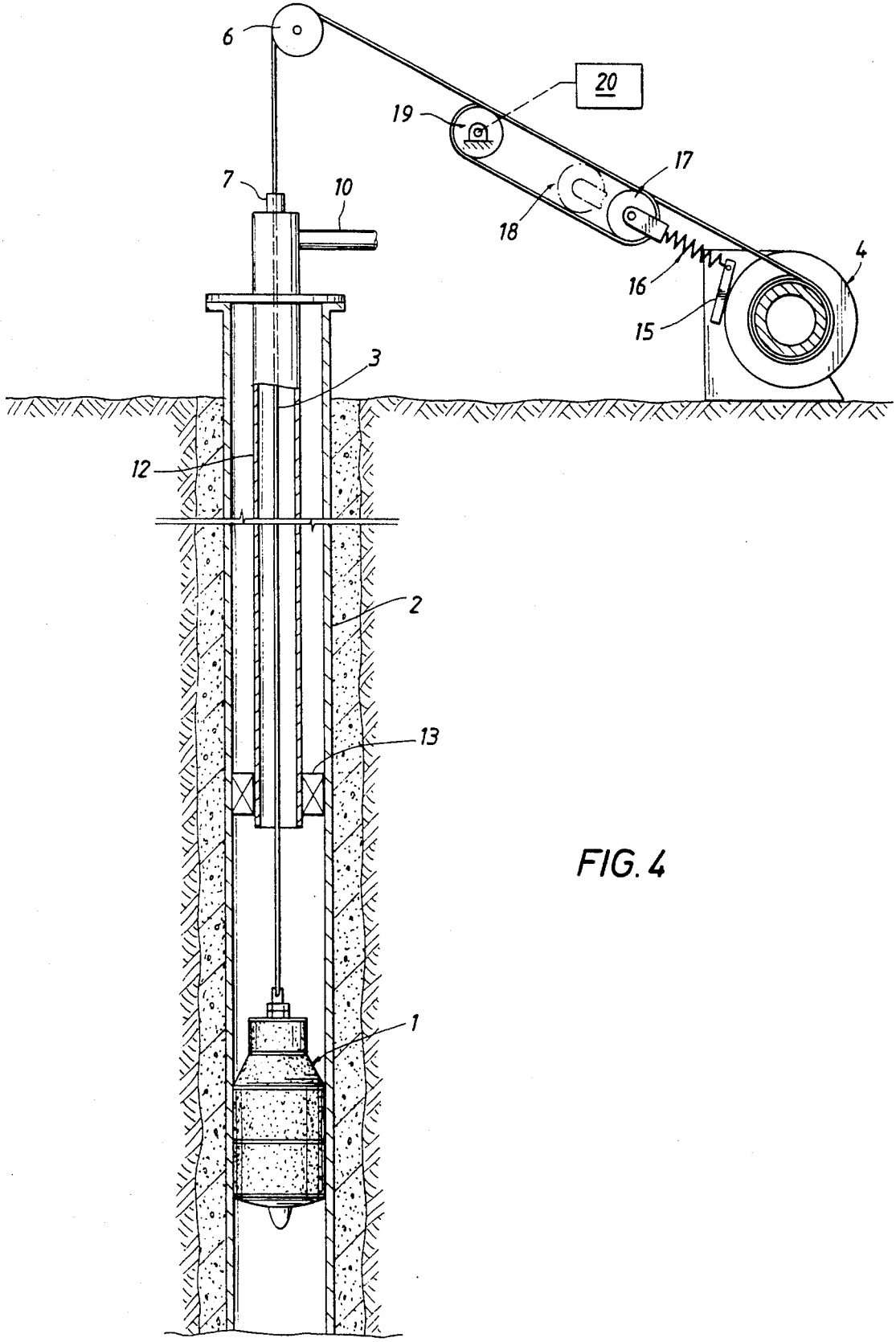
FIG. 4 is a schematic diagram of an alternative apparatus of the present invention.

FIG. 4 shows an alternative apparatus of the present invention. This apparatus is similar to FIG. 1, and elements are numbered identically, except that the line weight indicator, 5, control signal, 9, and feedback controller, 8, of FIG. 1 are replaced with a simple mechanical arrangement. In FIG. 4, tension is maintained by a mechanical drag element, 15, which is controlled by tension from a control spring, 16, attached to a traveling sheave, 17. The traveling sheave, 17, is shown in a low tension position. A phantom sheave, 18, is shown in a high tension position. When the traveling sheave is pulled toward the high tension position by the line, it pulls on the control spring, 16, which reduces drag on the spool, 4, through the mechanical drag element, 15. A fixed sheave, 19, is equipped with a counter and integrater, 20, to determine and record the line speed and the amount of line in the borehole. The spring, 16, must be equipped with an adjustment to provide a tension which slightly exceeds the weight of the high drag member, 1, plus the weight of the line, 3, in the wellbore when the high drag member is in the portion of the wellbore in which velocities are to be logged. The apparatus of FIG. 4 has the advantage of being simple and inexpensive.

These preferred high drag members can provide a very high resistance to flow around the member within the wellbore, while at the same time maintaining a low frictional resistance against the walls of the wellbore. The frictional forces of the high drag member against the wellbore walls at typical fluid velocities are preferably less than about the weight of the high drag member. This frictional force will then be sufficiently low that errors in its estimation will not significantly affect the logging of well fluid velocities.

The apparatus of the present invention is inserted into the wellbore, and then injection of fluids is established and maintained as the high drag member is lowered into the wellbore at a rate which results in no net fluid force on the high drag member, therefore enabling a direct measurement of the fluid velocities based on the rate that the line is spooled off.

When the high drag member of the present invention is utilized to log velocities in a steam injection application, it may be desirable to provide a temporary separator to separate any liquids which may be in the injection steam from the injection system. This prevents any accumulation of liquids either above or below the high drag member from affecting the tension on the high drag member. Accumulated liquids may be disposed of by injection into the wellbore after logging is complete. It has been found that liquids which are injected with steam will generally travel to the bottom of the wellbore, and exit the casing from the lower most perforations. Separating liquids from injection steam during velocity logging, and assuming that liquids would normally travel to the lowest perforations, will generally improve the accuracy of the velocity log obtained.

We claim:

1. A method for logging fluid velocities in a portion of a wellbore comprising the steps of:

providing a high drag member which passes through the portion of the wellbore to be logged with little frictional resistance against the wellbore walls and provides a high drag resistance for fluids passing around the high drag member within the wellbore;

suspending the high drag member within the wellbore by a line;

moving the high drag member within the wellbore at a velocity which results in tension on the line at the wellhead which equals or slightly exceeds the weight of the drag member and line in the wellbore; and determining the velocity of the fluids within the portion of the wellbore by measuring the rate at which the line is being taken up or fed out when the tension on the line slightly exceeds the weight of the drag member and line in the wellbore.

2. The method of claim 1 wherein the tension on the line is measured by a line weight indicator.

3. The method of claim 1 wherein the wellbore is a secondary recovery injection well, and the normal flow of secondary recovery fluids is being injected as the high drag member is lowered into the wellbore.

4. The method of claim 2 wherein the tension on the line at the wellhead is controlled to maintain a tension which slightly exceeds the weight of the drag member and line in the wellbore.

5. The method of claim 3 wherein the injection fluid comprises carbon dioxide.

6. The method of claim 3 wherein the injection fluid comprises natural gas.

7. The method of claim 3 wherein the injection fluid comprises steam.

8. A well logging apparatus capable of measuring fluid velocities within a wellbore comprising:

a) a high drag member which passes through the wellbore to be logged with little frictional resistance against the wellbore walls and provides a high drag resistance for fluids passing around the high drag member within the wellbore;

b) a line capable of suspending the high drag member within the wellbore;

c) a means to maintain a tension on the line at the wellhead which slightly exceeds the weight of the high drag member and line in the borehole;

d) a means for lowering and raising the high drag member within the wellbore at varying rates; and e) a means for measuring the speed at which the line is going into the wellbore or being pulled out of the wellbore.

9. The well logging apparatus of claim 8 wherein the means for determining the tension on the line is a line weight indicator.

10. The well logging apparatus of claim 8 further comprising a means to control the speed at which the line is going into the wellbore or being pulled out of the wellbore at a speed which results in the tension of the line at the surface being about equal to the buoyed weight of the line and high drag member.

11. The well logging apparatus of claim 8 wherein the high drag member comprises a plurality of sealing members separated by foam.

12. The well logging apparatus of claim 11 wherein the high drag member is attached to the line by a swivel device.

13. The well logging apparatus of claim 8 wherein the high drag member is a flexible inverted parachute apparatus suspended from the line from the center of the parachute when the tension on the line at the point the line is attached to the inverted parachute is low, and wherein the center of the parachute is pulled up when tension on the line at the point the line is attached to the inverted parachute is increased, causing the parachute to invert to a cone shape which can be pulled up through a casing and a tubing against a flow of injected fluids.

* * * * *